US009685747B2

(12) United States Patent
Chen

(10) Patent No.: US 9,685,747 B2
(45) Date of Patent: Jun. 20, 2017

(54) ELECTRICAL CONNECTOR AND METHOD FOR MANUFACTURING THE SAME

(71) Applicant: LOTES CO., LTD, Keelung (TW)

(72) Inventor: Xiao Li Chen, Keelung (TW)

(73) Assignee: LOTES CO., LTD, Keelung (TW)

( * ) Notice: Subject to any disclaimer, the term of this patent is extended or adjusted under 35 U.S.C. 154(b) by 85 days.

(21) Appl. No.: 14/575,858

(22) Filed: Dec. 18, 2014

(65) Prior Publication Data

US 2015/0357771 A1 Dec. 10, 2015

(30) Foreign Application Priority Data

Jun. 6, 2014 (CN) ..... 2014 1 0275806

(51) Int. Cl.

| | |
|---|---|
| ***H01R 13/502*** | (2006.01) |
| ***H01R 13/506*** | (2006.01) |
| ***H01R 24/70*** | (2011.01) |
| ***H01R 43/16*** | (2006.01) |
| ***H01R 43/20*** | (2006.01) |
| ***H01R 43/24*** | (2006.01) |
| *H01R 13/514* | (2006.01) |
| *H01R 12/71* | (2011.01) |
| *H01R 13/6474* | (2011.01) |

(Continued)

(52) U.S. Cl.

CPC ..... *H01R 24/70* (2013.01); *H01R 13/502* (2013.01); *H01R 13/506* (2013.01); *H01R 43/16* (2013.01); *H01R 43/20* (2013.01); *H01R 43/24* (2013.01); *H01R 12/716* (2013.01); *H01R 13/514* (2013.01); *H01R 13/6474* (2013.01); *H01R 13/6582* (2013.01); *H01R 24/60* (2013.01); *Y10T 29/4921* (2015.01)

(58) Field of Classification Search

CPC .. H01R 13/514; H01R 13/502; H01R 13/504; H01R 13/506

USPC ..... 439/686, 687, 695, 701, 712, 713, 724, 439/731, 607.55, 941

See application file for complete search history.

(56) References Cited

U.S. PATENT DOCUMENTS 5,613,882 A * 3/1997 Hnatuck ..... H01R 13/506 439/372

6,210,218 B1 * 4/2001 Chang ..... H01R 12/7029 439/567

(Continued)

*Primary Examiner* — Renee Luebke
*Assistant Examiner* — Paul Baillargeon
(74) *Attorney, Agent, or Firm* — Locke Lord LLP; Tim Tingkang Xia, Esq.

(57) ABSTRACT

A method for manufacturing an electrical connector and an electrical connector manufactured by the same. The method includes: separately stamping a first terminal and a second terminal, where the first terminal has a first welding portion, and the second terminal has a second welding portion; insert-molding the first terminal in a first body and a second body, and insert-molding the second terminal in a third body and a fourth body; assembling and locating the first body and the third body, and assembling and locating the second body and the fourth body; and synchronously bending the first terminal and the second terminal. Relative locations of the first welding portion and the second welding portion are unchanged, which ensures that the first welding portion and the second welding portion are located at predetermined locations, ensures good welding of the electrical connector, and ensures a reliable electrical connection.

13 Claims, 11 Drawing Sheets

(51) Int. Cl.
*H01R 13/6582* (2011.01)
*H01R 24/60* (2011.01)

(56) References Cited

U.S. PATENT DOCUMENTS 7,748,999 B1 * 7/2010 Sun ..... H01R 12/716
439/607.36
8,021,188 B1 * 9/2011 Ma ..... H01R 12/722
439/607.55
8,033,868 B2 * 10/2011 Wang ..... H01R 13/405
439/660
8,052,487 B2 * 11/2011 Zhu ..... H01R 13/4361
439/695
8,157,599 B2 * 4/2012 Wei ..... H01R 13/502
439/607.01
8,911,258 B2 * 12/2014 Soubh ..... H01R 12/724
439/638
8,944,850 B2 * 2/2015 Simmel ..... H01R 43/20
439/607.55

* cited by examiner

ELECTRICAL CONNECTOR AND METHOD FOR MANUFACTURING THE SAME

CROSS-REFERENCE TO RELATED APPLICATION

This non-provisional application claims priority under 35 U.S.C. §119(a) on Patent Application No. 201410275806.1 filed in P.R. China on Jun. 6, 2014, the entire contents of which are hereby incorporated by reference.

Some references, if any, which may include patents, patent applications and various publications, may be cited and discussed in the description of this invention. The citation and/or discussion of such references, if any, is provided merely to clarify the description of the present invention and is not an admission that any such reference is "prior art" to the invention described herein. All references listed, cited and/or discussed in this specification are incorporated herein by reference in their entireties and to the same extent as if each reference was individually incorporated by reference.

FIELD OF THE INVENTION

The present invention relates to an electrical connector and a method for manufacturing the same, and in particular, to an electrical connector that can ensure a correct location of a welding portion of a terminal and a method for manufacturing the same.

BACKGROUND OF THE INVENTION

An electrical connector disclosed in U.S. Pat. No. 7,485,008 includes a first body 18, a second body 12 fastened to the first body 18, and a shell 20 externally sleeved on the first body 11 and the second body 18. Multiple first terminals 30 are disposed in the first body 18. The first terminal 30 has a first fixing portion 36 fixed in the first body 18. The front end of the first fixing portion 36 is extended to form a first contact portion 32. The rear end of the first fixing portion 36 is bent and extended to form a first welding portion 34. Multiple second terminals 40 are disposed in the second body 12. The second terminal 40 has a second fixing portion 46 fixed in the second body 12. The front end of the second fixing portion 46 is extended to form a second contact portion 42. The rear end of the second fixing portion 46 is bent and extended to form a second welding portion 44.

In a manufacturing process, the first terminal 30 and the second terminal 40 are first stamped, and the first terminal 30 and the second terminal 40 respectively form the first welding portion 34 and the second welding portion 44 that are bent. Then, the first terminal 30 is insert-molded in the first body 18, and the second terminal 40 is insert-molded in the second body 12. After that, the first body 18 is assembled with the second body 12. Finally, the shell 20 is externally sleeved on the first body 18 and the second body 12.

However, in a production and manufacturing process, bending degrees of the first terminal 30 and the second terminal 40 are different, leading to different heights of the first welding portion 34 and the second welding portion 44. After the first terminal 30 is insert-molded in the first body 18 and the second terminal 40 is insert-molded in the second body 12, the first body 18 is assembled with the second body 12. After assembling, the locations of the first welding portion 34 and the second welding portion 44 may be not predetermined locations of the first welding portion 34 and the second welding portion 44 because of a manufacturing problem of the first terminal 30 and the second terminal 40. When the electrical connector is welded on a circuit board, some of the first terminals or the second terminals do not contact the circuit board because of different heights, leading to poor welding, thereby affecting normal electrical transmission of the electrical connector.

Therefore, a heretofore unaddressed need exists in the art to address the aforementioned deficiencies and inadequacies.

SUMMARY OF THE INVENTION

In one aspect, the present invention is directed to a method for manufacturing an electrical connector for ensuring a location of a welding portion of a terminal and an electrical connector manufactured by using the same method.

In one embodiment, a method for manufacturing an electrical connector includes:

step a): separately stamping a first terminal and a second terminal, where the first terminal has a first welding portion, and the second terminal has a second welding portion;

step b): insert-molding the first terminal in a first body and a second body, and insert-molding the second terminal in a third body and a fourth body, where the first body and the second body are separately disposed, and the third body and the fourth body are separately disposed;

step c): assembling and locating the first body and the third body, and assembling and locating the second body and the fourth body; and step d): synchronously bending the first terminal and the second terminal, so as to change relative locations of the second body and the first body.

In one embodiment, in step a), when the first terminal and the second terminal are stamped, a pre-bent portion is disposed separately in the middle of each first terminal and the middle of each second terminal, and the thickness of the pre-bent portion is less than the thickness of other parts of the first terminal and the second terminal.

In one embodiment, after step c) is completed, the pre-bent portions of the first terminal and the second terminal are arranged in a same row.

In one embodiment, in step d), the first terminal and the second terminal are bent at the pre-bent portions.

In one embodiment, in step a), when the first terminal and the second terminal are stamped, the first welding portion and the second welding portion are bent in a surface-mounted manner.

In one embodiment, after step c) is completed, the first welding portion and the second welding portion are arranged in a row.

In one embodiment, after step d) is completed, a cylindrical portion of a shell externally mantles the first body and the third body first, and then, a covering portion disposed at the rear end of the shell bends to cover the rear end of the second body.

In one embodiment, a shielding sheet is spot-welded on the shell, so that the shielding sheet and the shell form integral shielding together.

In one embodiment, before step d), the first terminal is in a flat and straight state, the second body and the first body are coplanar, the second terminal is in a flat and straight state, and the fourth body and the third body are coplanar. Further, in step d), after the first terminal and the second terminal are synchronously bent, the second body is perpendicular to the first body, and the fourth body is perpendicular to the third body.

In another aspect, the present invention is directed to an electrical connector. In one embodiment, an electrical connector includes a first terminal, a second terminal, a first body, a second body, a third body, and a fourth body.

The first terminal has a first fixing portion. The front end of the first fixing portion extends to form a first contact portion. The rear end of the first fixing portion bends and extends to form a second fixing portion. The rear end of the second fixing portion extends to form a first welding portion. The first body and the second body are separately disposed. The first body is fixed to the first fixing portion, and the second body is fixed to the second fixing portion. The second body is located at the rear of the first body.

The second terminal has a third fixing portion. The front end of the third fixing portion extends to form a second contact portion. The rear end of the third fixing portion bends and extends to form a fourth fixing portion. The rear end of the fourth fixing portion extends to form a second welding portion. The third body and the fourth body are separately disposed. The third body is fixed to the third fixing portion, and the fourth body is fixed to the fourth fixing portion. The third body is located below the first body, and is fastened to the first body, and the fourth body is fastened to the second body.

In one embodiment, a first bent portion is disposed between the first fixing portion and the second fixing portion, and exposed from the first body and the second body. A second bent portion is disposed between the third fixing portion and the fourth fixing portion, and exposed from the third body and the fourth body.

In one embodiment, the first bent portion and the second bent portion are arranged in a same row.

In one embodiment, the first welding portion and the second welding portion are located in a same row.

In one embodiment, the first welding portions are located at two sides of the second welding portion, and the numbers of the first welding portions located at the two sides of the second welding portion are different.

In one embodiment, the second fixing portions are laterally bent relative to the first fixing portions, such that the second fixing portions and the fourth fixing portion are located in a same row, and the second fixing portions are located at two sides of the fourth fixing portion.

In one embodiment, viewed from the top, the third fixing portion is located between two neighboring the first fixing portions.

In one embodiment, a distance between the first fixing portions located at two sides of the third fixing portion is greater than a distance between two neighboring the first fixing portions far from the third fixing portion.

In one embodiment, a first receiving slot and a second receiving slot are disposed in the first body, and the second receiving slot is located at the rear of the first receiving slot. The first contact portion is located in the first receiving slot, and the second contact portion extends out from the third body and is located in the second receiving slot.

In one embodiment, in a forward to backward direction, the fourth body is located between the second body and the first body.

In one embodiment, the fourth body is backward provided with at least one protruding sheet in a protuberant manner, and the protruding sheet protuberantly extends between neighboring the second fixing portions, and coordinates with the second body to perform locating.

In one embodiment, the first body has a main body portion and at least one positioning post extending downward from the main body portion. The second body is located at the rear of the positioning post. At least one hook is extended forward from the second body and is buckled to the positioning post, such that the fourth body is held between the second body and the positioning post.

In one embodiment, the electrical connector further includes a shell covering the first body and the second body, and a shielding sheet spot-welded with the shell, such that the shell and the shielding sheet form integral shielding together.

Compared with the related art, the present invention, among other things, has the following beneficial advantages.

The first terminal has the first welding portion, and the second terminal has the second welding portion. After the first terminal is insert-molded in the first body and the second body, and the second terminal is insert-molded in the third body and the fourth body, the first body and the third body are assembled, the second body and the fourth body are assembled. Then the first terminal and the second terminal are synchronously bent, such that the relative locations of the second body and the first body are changed, but, the relative locations of the first welding portion and the second welding portion are unchanged, which can ensure that the first welding portion and the second welding portion are located at predetermined locations of the first welding portion and the second welding portion, thereby ensuring that the electrical connector is well welded, and further ensuring a reliable electrical connection.

These and other aspects of the present invention will become apparent from the following description of the preferred embodiment taken in conjunction with the following drawings, although variations and modifications therein may be effected without departing from the spirit and scope of the novel concepts of the disclosure.

DETAILED DESCRIPTION OF THE INVENTION

Figure 1:
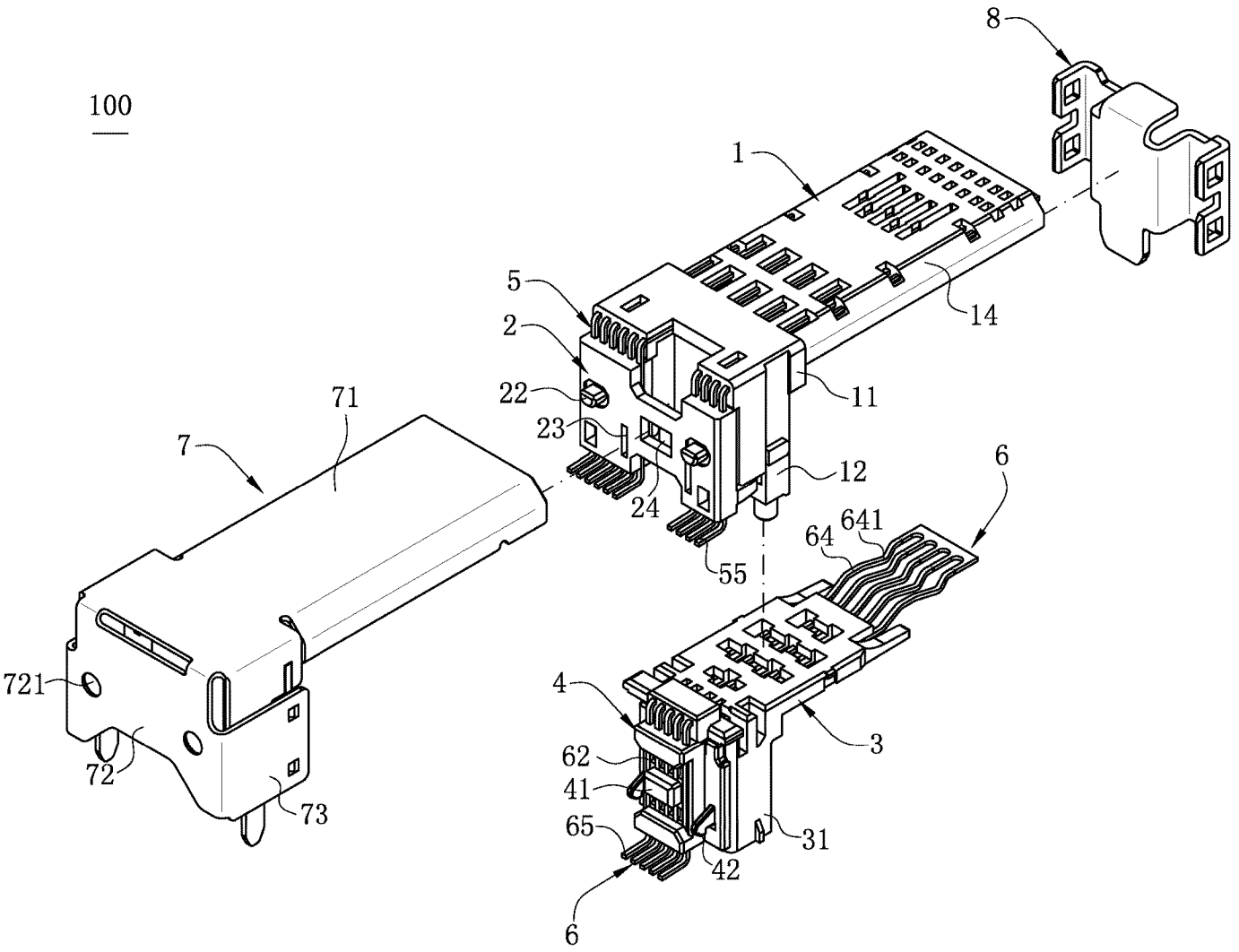
FIG. 1 is a schematic three-dimensional exploded view of an electrical connector according to one embodiment of the present invention.

The present invention is more particularly described in the following examples that are intended as illustrative only since numerous modifications and variations therein will be apparent to those skilled in the art. Various embodiments of the invention are now described in detail. Referring to the drawings, like numbers indicate like components throughout the views. As used in the description herein and throughout the claims that follow, the meaning of "a", "an", and "the" includes plural reference unless the context clearly dictates otherwise. Also, as used in the description herein and throughout the claims that follow, the meaning of "in" includes "in" and "on" unless the context clearly dictates otherwise. Moreover, titles or subtitles may be used in the specification for the convenience of a reader, which shall have no influence on the scope of the present invention.

It will be understood that when an element is referred to as being "on" another element, it can be directly on the other element or intervening elements may be present therebetween. In contrast, when an element is referred to as being "directly on" another element, there are no intervening elements present. As used herein, the term "and/or" includes any and all combinations of one or more of the associated listed items.

Furthermore, relative terms, such as "lower" or "bottom" and "upper" or "top," may be used herein to describe one element's relationship to another element as illustrated in the Figures. It will be understood that relative terms are intended to encompass different orientations of the device in addition to the orientation depicted in the Figures. For example, if the device in one of the figures is turned over, elements described as being on the "lower" side of other elements would then be oriented on "upper" sides of the other elements. The exemplary term "lower", can therefore, encompasses both an orientation of "lower" and "upper," depending of the particular orientation of the figure. Similarly, if the device in one of the figures is turned over, elements described as "below" or "beneath" other elements would then be oriented "above" the other elements. The exemplary terms "below" or "beneath" can, therefore, encompass both an orientation of above and below.

As used herein, "around", "about" or "approximately" shall generally mean within 20 percent, preferably within 10 percent, and more preferably within 5 percent of a given value or range. Numerical quantities given herein are approximate, meaning that the term "around", "about" or "approximately" can be inferred if not expressly stated.

As used herein, the terms "comprising", "including", "carrying", "having", "containing", "involving", and the like are to be understood to be open-ended, i.e., to mean including but not limited to.

The description will be made as to the embodiments of the present invention in conjunction with the accompanying drawings in FIGS. 1-9. In accordance with the purposes of this invention, as embodied and broadly described herein, this invention, in one aspect, relates to an electrical connector.

As shown in FIG. 1, an electrical connector 100 according to one embodiment of the present invention includes a first body 1, a second body 2, a third body 3, a fourth body 4, multiple first terminals 5, multiple second terminals 6, a shell 7 and a shielding sheet 8. The second body 2 is located at the rear of the first body 1. The third body 3 is located below the first body 1. The fourth body 4 is located in front of the second body 2. The first terminals 5 are arranged in the first body 1 and the second body 2 in a row. The second terminals 6 are arranged in the third body 3 and the fourth body 4 in a row. The shell 7 and the shielding sheet 8 together cover the first body 1, the second body 2, the third body 3, and the fourth body 4 externally.

Figure 4:
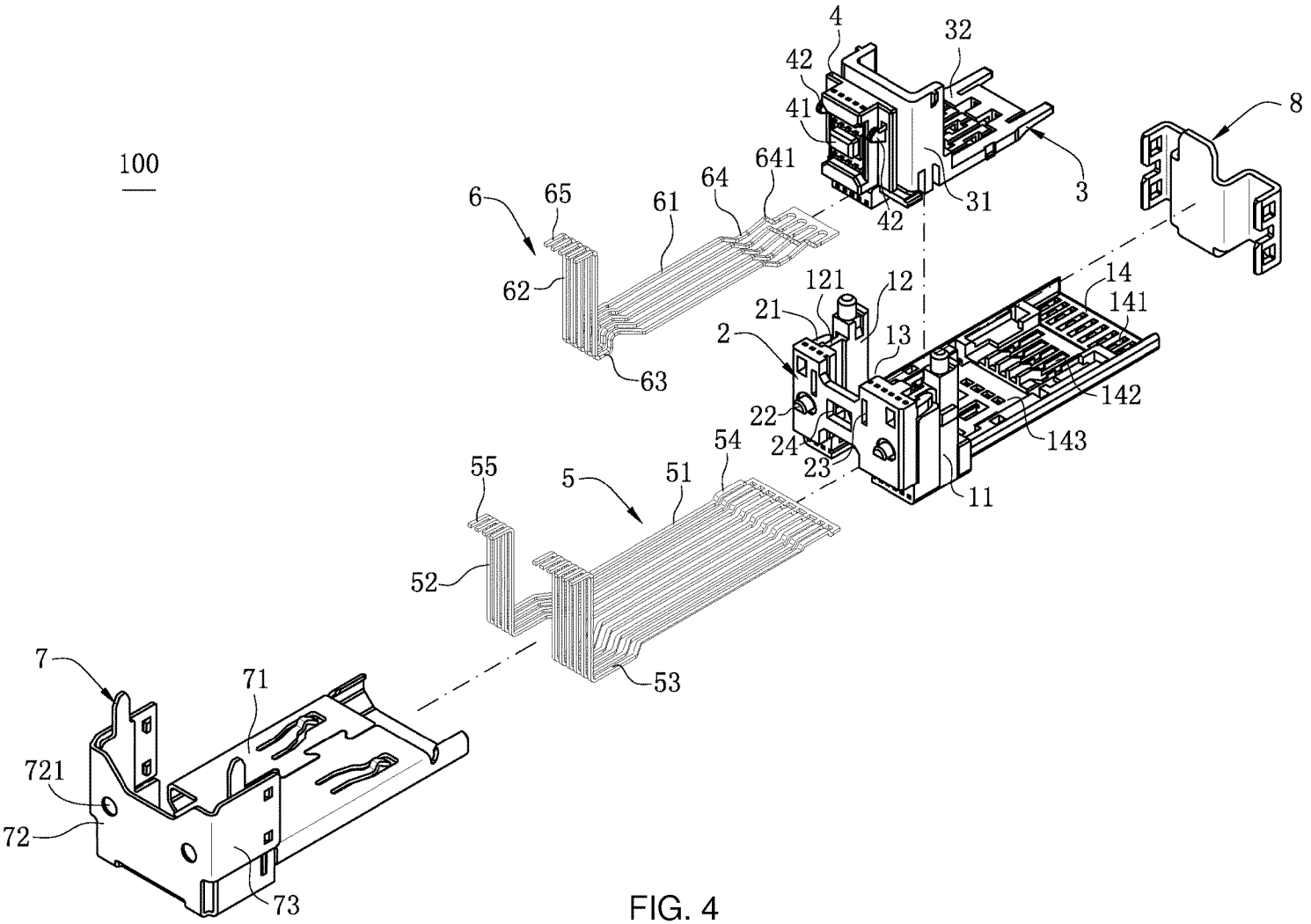
FIG. 4 is a schematic three-dimensional exploded view of an electrical connector according to one embodiment of the present invention viewed from another angle.
Figure 5:
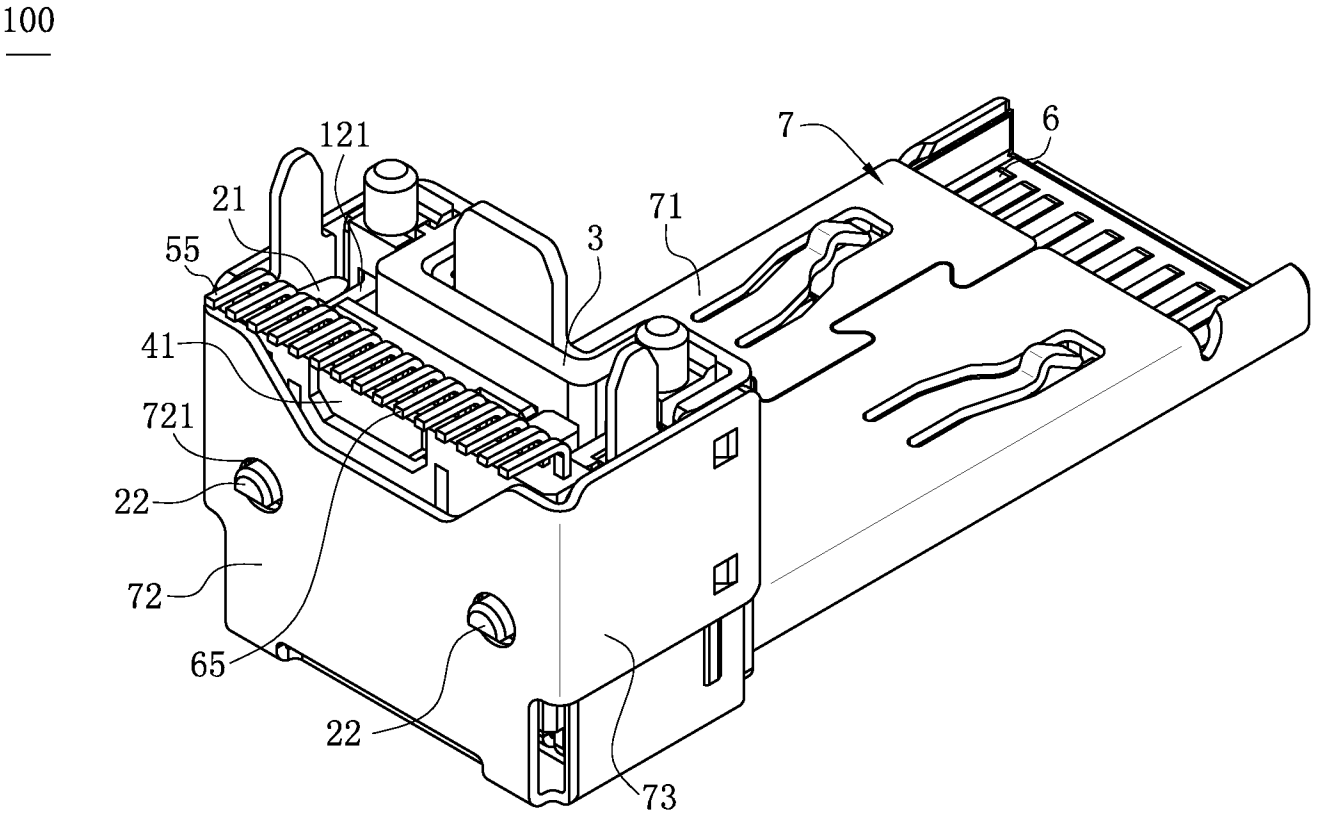
FIG. 5 is a schematic three-dimensional assembly view of an electrical connector according to one embodiment of the present invention viewed from another angle.

As shown in FIG. 1 and FIG. 4, the first body 1 includes a main body portion 11. Two sides of the main body portion 11 are each backward protruded with a positioning post 12. An accommodating space 13 is formed between the two positioning posts 12 for the third body 3 to be entered therein. Each of the positioning posts 12 is provided with a buckling portion 121. A first tongue plate 14 extends forward from the main body portion 11. Multiple first receiving slots 141 and multiple second receiving slots 142 are opened on the lower surface of the first tongue plate 14. The second receiving slots 142 are located at the rear of the first receiving slots 141. The first receiving slots 141 are ten in number and form a row, and the second receiving slots 142 are five in number and form another row. An accommodating groove 143 is disposed at the rear of the second receiving slot 142 in a concave manner, and the depth of the accommodating groove 143 is roughly the same as the thickness of the third body 3.

As shown in FIG. 1 and FIG. 4, the second body 2 is located at the rear of the first body 1. The second body 2 and the first body 1 are separately disposed. The second body 2 is perpendicular to the first tongue plate 14. A hook 21 is protruded forwardly at each of two sides of the second body 2, and is used to buckle the corresponding buckling portion 121 on the positioning post 12 for positioning. The second body 2 is protruded backwardly with at least one protruding post 22, which is used to locate the shell 7. The second body 2 is provided with at least one through groove 23 and multiple through holes 24.

Figure 6A:
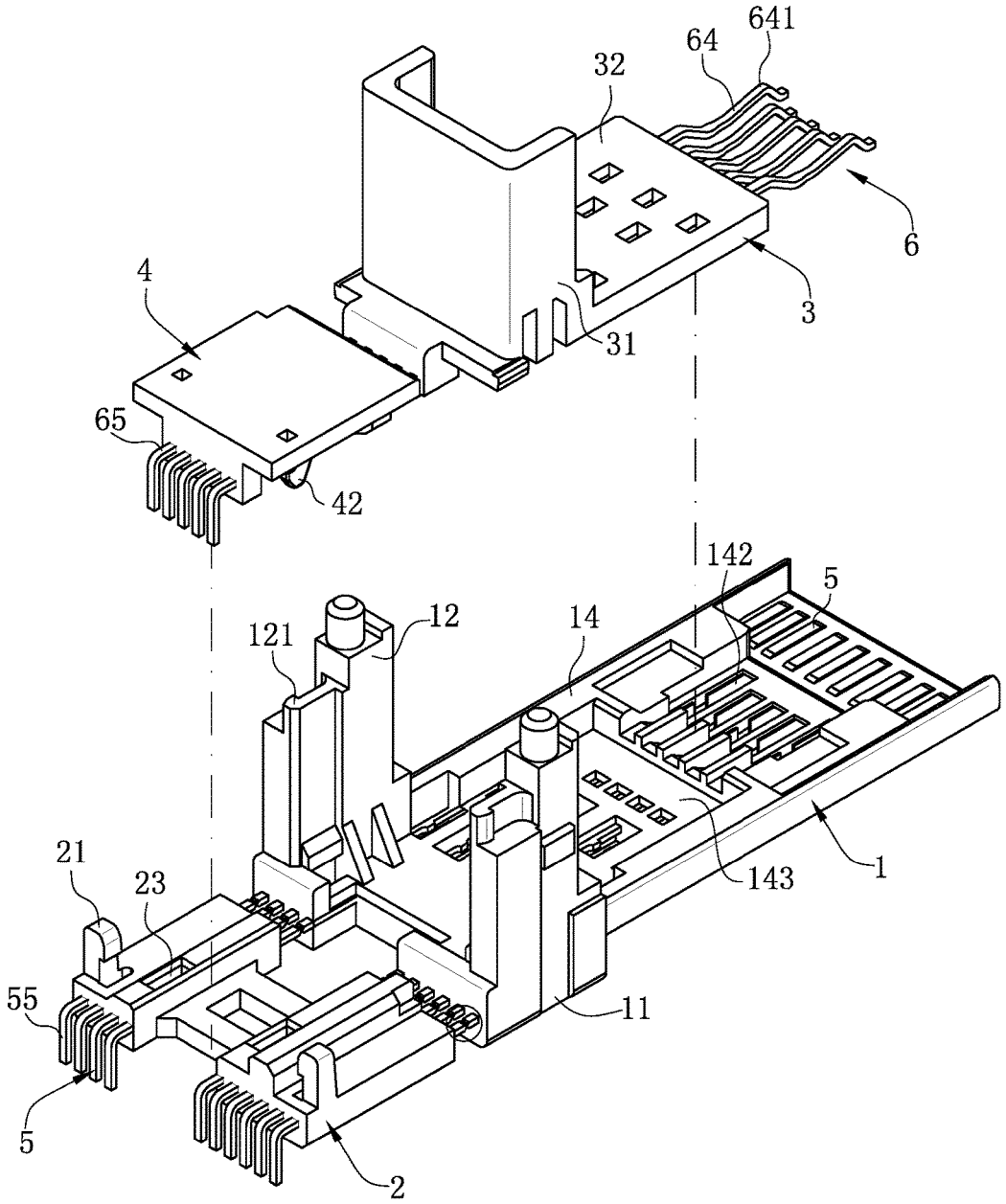
FIG. 6A is a schematic three-dimensional view of a first body and a third body that are not assembled of an electrical connector according to one embodiment of the present invention.
Figure 6B:
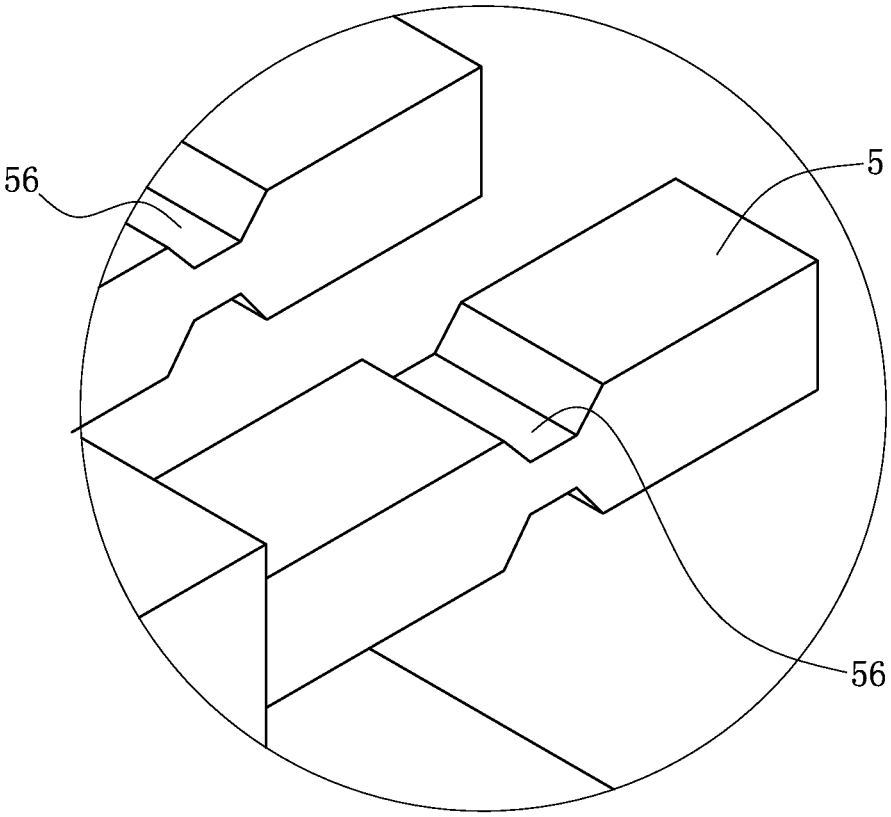
FIG. 6B is an enlarged view of a part that is highlighted by a circle in FIG. 6A.

As shown in FIG. 4, FIG. 6A and FIG. 6B, each first terminal 5 has a first fixing portion 51 fixed in the first body 1. In this embodiment, the first fixing portion 51 is fixed in the first body 1 in an insert-molding manner. The first fixing portion 51 extends forwardly to form a first contact portion 54. The first contact portion 54 is in a flat plate shape, and is located in the first receiving slot 141. In this embodiment, a plane on which the first contact portion 54 is located is lower than a plane on which the first fixing portion 51 is located, such that the first contact portion 54 is exposed on a surface of the first tongue plate 14. The rear end of the first fixing portion 51 bends downwardly and extends to form a second fixing portion 52. The second fixing portion 52 is perpendicular to the first fixing portion 51, and is fixed in the second body 2. In this embodiment, the second fixing portion 52 is insert-molded in the second body 2. A first bent portion 53 is disposed between the second fixing portion 52 and the first fixing portion 51, and exposed from the first body 1 and the second body 2. The first terminals 5 are all arranged in a row. In the arrangement direction, four of the second fixing portions 52 laterally bend toward one side relative to the first fixing portions 51, and six of the second fixing portions 52 laterally bend toward the other side opposite to the one side relative to the first fixing portions 51. The tail end of each second fixing portion 52 bends and extends to form a first welding portion 55. The first welding portions 55 is horizontally disposed, and is surface mounted on a circuit board (not shown in the figures) by welding. The first welding portions 55 are arranged in a row.

Figure 3:
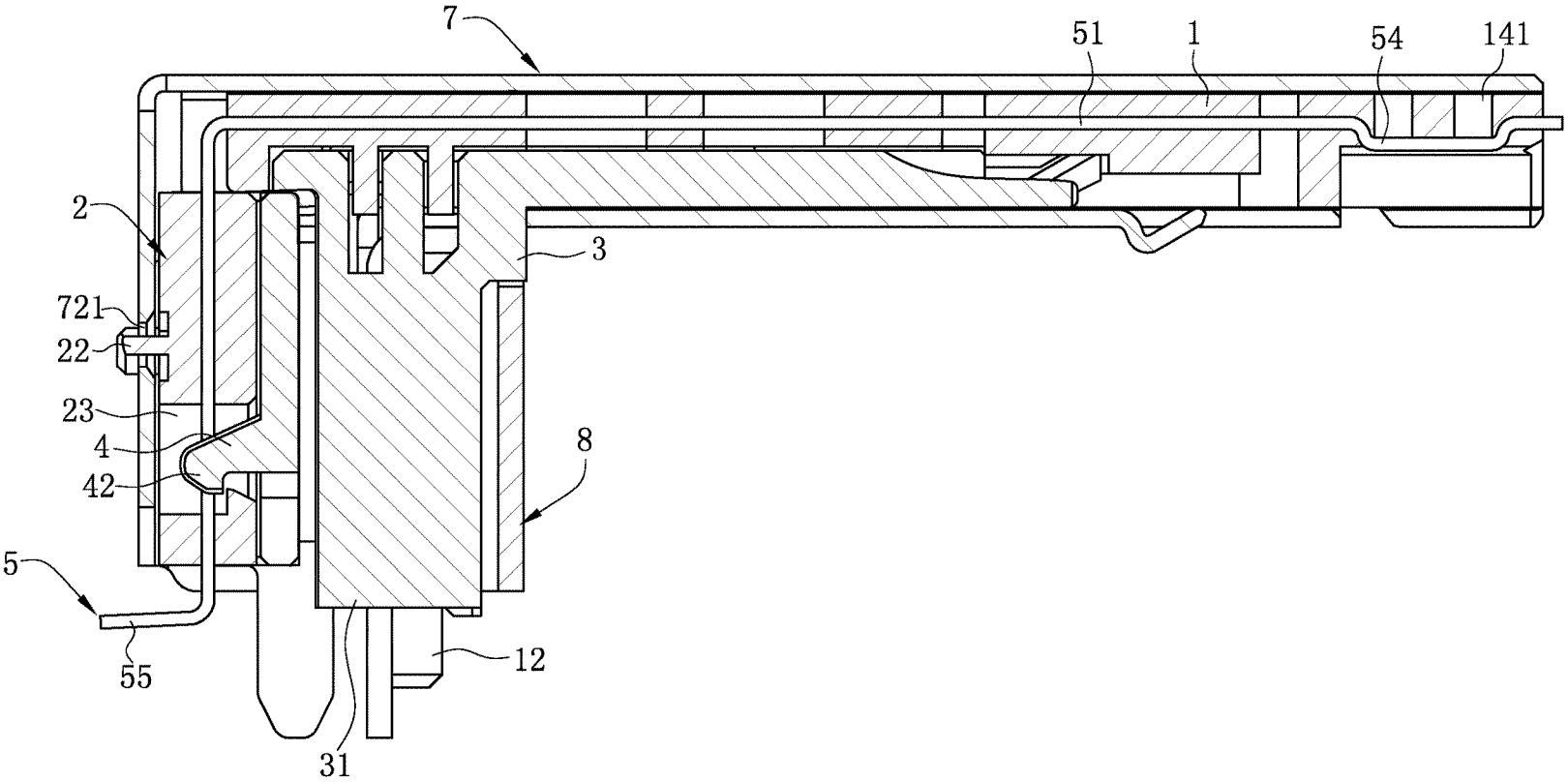
FIG. 3 is a schematic sectional view of an electrical connector according to one embodiment of the present invention.

As shown in FIG. 1 and FIG. 3, the third body 3 is located below the first body 1, and has a vertical base portion 31. The base portion 31 extends forwardly to form a second tongue plate 32. The base portion 31 enters the accommodating space 13 and is located between the two positioning posts 12. The second tongue plate 32 is placed in the accommodating groove 143, such that the bottom of the second tongue plate 32 is flush with the bottom of the first tongue plate 14.

Figure 2:
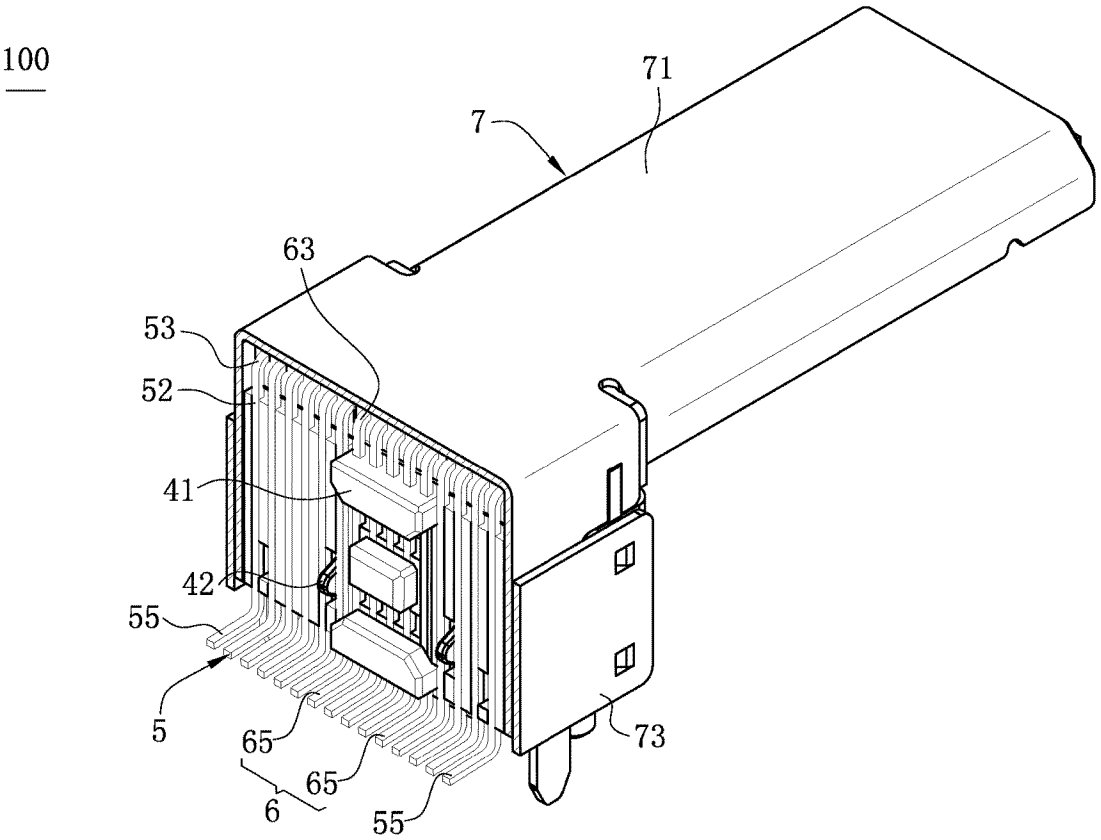
FIG. 2 is a schematic three-dimensional assembly view of an electrical connector according to one embodiment of the present invention.
Figure 7:
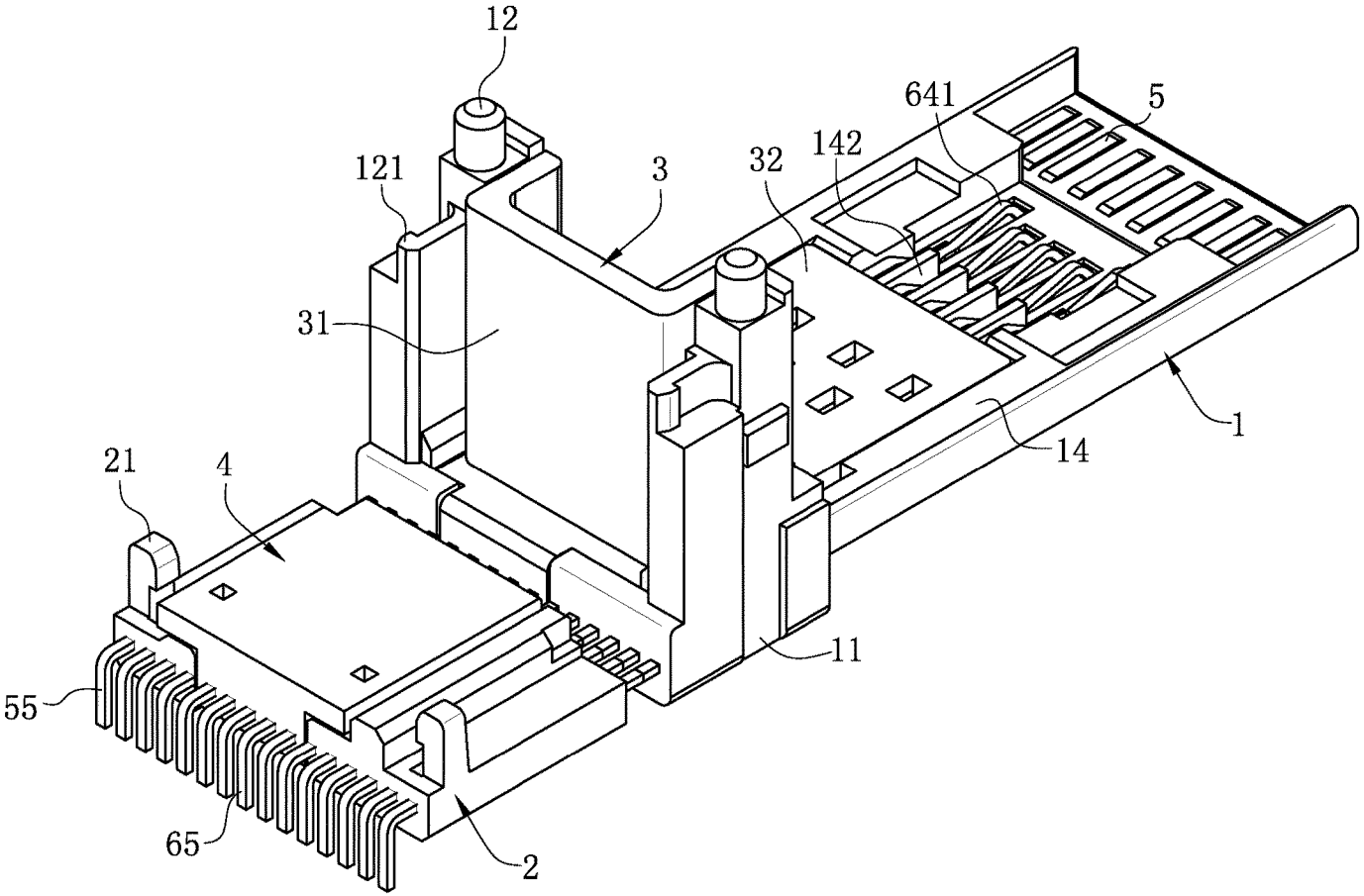
FIG. 7 is a schematic three-dimensional view of a first body and a third body which are assembled of an electrical connector according to one embodiment of the present invention.

As shown in FIG. 4 and FIG. 7, the fourth body 4 is located at the rear of the first body 1 and the third body 3, and in front of the second body 2. That is, the fourth body 4 is located between the base portion 31 and the second body 2. Specifically, the fourth body 4 is located between the positioning posts 12 and the second body 2. The fourth body 4 and the third body 3 are separately disposed. That is, the fourth body 4 and the third body 3 are disposed as two pieces. The fourth body 4 is attached to the base portion 31, and is disposed perpendicular to the second tongue plate 32. Multiple protruding blocks 41 protrude backwardly from the fourth body, and enter the through holes 24, so as to position the fourth body 4 and the second body 2. A protruding sheet 42 is disposed at each of two sides of the protruding block 41 of the fourth body 4. The protruding sheets 42 are buckled in the through grooves 23. As shown in FIG. 2, each protruding sheet 42 protrudes between two neighboring the second fixing portions 52, and is fixed to the second body 2 after passing through the second fixing portion 52.

Figure 9A:
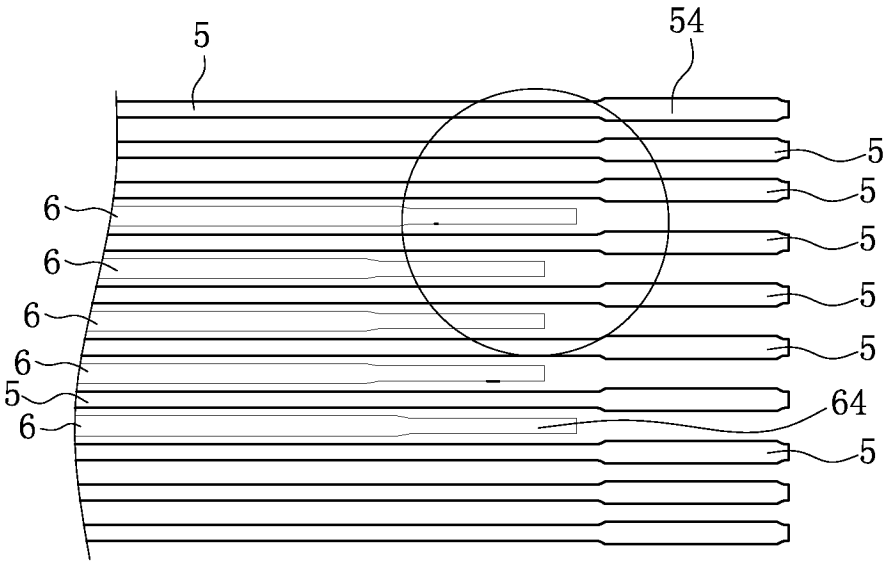
FIG. 9A is a schematic top view and a partially enlarged view of a first terminal and a second terminal of an electrical connector according to one embodiment of the present invention.
Figure 9B:
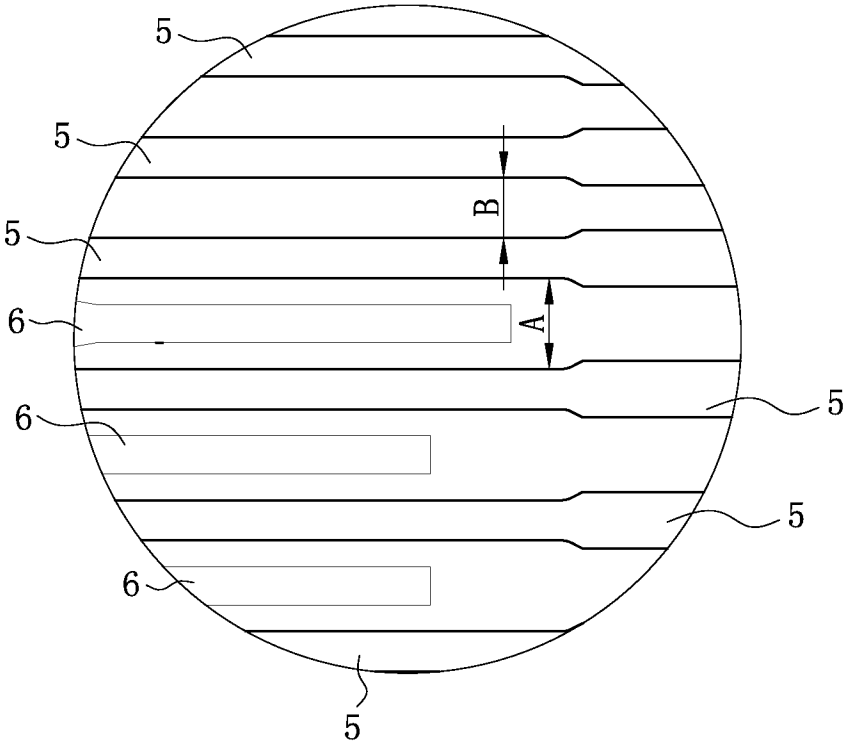
FIG. 9B is an enlarged view of a part that is highlighted by a circle in FIG. 9A.

As shown in FIG. 4, FIG. 6A and FIG. 6B, each second terminal 6 has a third fixing portion 61 fixed in the third body 3. In this embodiment, the third fixing portion 61 is insert-molded in the third body 3. The third fixing portion 61 and the first fixing portion 51 are located at different heights. As shown in FIG. 9A and FIG. 9B, the first fixing portions 51 and the third fixing portions 61 are separately arranged in two rows which are disposed with one on the top of the other. Viewed from a plane on which the first fixing portions 51 or the third fixing portions 61 are located, that is, viewed from the top downwardly, each third fixing portion 61 is located between two neighboring the first fixing portions 51, and a distance A between the first fixing portions 51 located at two sides of the third fixing portion 61 is greater than a distance B between two neighboring the first fixing portions 51 far from the third fixing portion 61, so as to make a distance between the first fixing portion 51 and the third fixing portion 61 as large as possible, achieving a better high-frequency signal transmission effect. The third fixing portion 61 extends forwardly to form an elastic arm 64. The elastic arm 64 is located in the second receiving slot 142, and protrudes out from the front end of the third body 3. The elastic arm 64 has a bent second contact portion 641, and the second contact portion 641 is exposed on a surface of the first tongue plate 14. The rear end of the third fixing portion 61 bends downwardly and extends to form a fourth fixing portion 62 fixed in the fourth body 4. In this embodiment, the fourth fixing portion 62 is insert-molded in the fourth body 4. A second bent portion 63 is disposed between the fourth fixing portion 62 and the third fixing portion 61. Each second bent portion 63 is formed by bending the rear end of the third fixing portion 61, such that the second bent portions 63 and the first bent portions 53 are located in a same row, thereby making the fourth fixing portions 62 and the second fixing portions 52 located in a same row. The second fixing portions 52 are laterally bent toward two sides, so that the fourth fixing portions 62 are located between the second fixing portions 52. The numbers of the second fixing portions 52 at two sides of the fourth fixing portions 62 are different. Preferably, the numbers of the second fixing portions 52 at the two sides are respectively four and six. The tail end of each fourth fixing portion 62 bends and extends to form a second welding portion 65. The second welding portions 65 are horizontally disposed. The second welding portions 65 and the first welding portions 55 are arranged in a row, and are both surface-mounted on the circuit board by welding, which ensures the welding planeness. The first welding portions 55 are located at two sides of the second welding portions 65. Preferably, the numbers of the first welding portions 55 at the two sides of the second welding portions 65 are different. That is, the first welding portions 55 at the two sides of the second welding portions 65 are asymmetrically disposed, which improves the high-frequency performance.

As shown in FIG. 1 and FIG. 4, the shell 7 includes a cylindrical portion 71. The cylindrical portion 71 externally covers the first body 1 and the third body 3, and the rear end of the cylindrical portion 71 integrally extends to form a covering portion 72. After the cylindrical portion 71 covers the first body 1 and the third body 3, the covering portion 72 bends to cover the rear end of the second body 2. A positioning hole 721 is disposed on the covering portion 72 for positioning the protruding post 22. Two sides of the covering portion 72 are each laterally bent and extended to form a sheet-shaped portion 73. The sheet-shaped portions 73 cover the side surfaces of the second body 2 and the first body 1.

As shown in FIG. 1 and FIG. 2, the electrical connector 100 further includes a shielding sheet 8 covering the front end surface of the main body portion 11 of the first body 1. The shielding sheet 8 and the shell 7 are disposed to together surround the first body 1, the second body 2, the third body 3, and the fourth body 4, so as to form integral shielding. Preferably, the shielding sheet 8 is fixed to the shell 7 in a laser spot welding manner, and alternatively, in other embodiments, the shielding sheet 8 may also be fixed to the shell 7 in a buckling manner.

The electrical connector 100 is surface mounted on the circuit board by welding. To ensure the welding planeness, a method for manufacturing the electrical connector 100 is as follows.

As shown in FIG. 6A and FIG. 6B, step a): separately stamping a row of the first terminals 5 and a row of the second terminals 6. In this case, the first fixing portions 51 and the second fixing portions 52 are disposed in a flat and straight manner. The third fixing portions 61 and the fourth fixing portions 62 are disposed in a flat and straight manner. The elastic arms 64 are formed by bending relative to the third fixing portions 61. The second welding portions 65 and the first welding portions 55 are bent in a surface-mounted manner. When stamping is performed, a pre-bent portion 56 is disposed by stamping in the middle of each first terminal 5 and the middle of each second terminal 6, and the thickness of the pre-bent portion 56 are less than the thickness of other parts of the first terminal 5 and the second terminal 6.

As shown in FIG. 6A and FIG. 6B, at step b), the first terminals 5 are respectively insert-molded in the first body 1 and the second body 2 that are separately disposed. The second body 2 is disposed in parallel with the first tongue plate 14. The second terminals 6 are insert-molded in the third body 3 and the fourth body 4 that are separately disposed. The fourth body 4 is disposed in parallel with the second tongue plate 32. Thus, by insert-molding, the first terminals 5 cannot move in the first body 1 and/or the second body 2, and the second terminals 6 cannot move in the third body 3 and/or the fourth body 4.

As shown in FIG. 4 and FIG. 7, step c): assembling the first body 1 and the third body 3, and assembling the second body 2 and the fourth body 4. In this case, the second tongue plate 32 is installed in the accommodating groove 143, the base portion 31 is located between the two positioning posts 12, the fourth body 4 is located at the rear of the first body 1 and the third body 3, and the protruding block 41 enters the through hole 24 so that the fourth body 4 and the second body 2 are fixed, thereby enabling the first welding portions 55 at the rear of the second body 2 and the second welding portions 65 at the rear of the fourth body 4 to be arranged in a same row. Moreover, the pre-bent portions 56 of the first terminals 5 and the second terminals 6 are also located in a same row. By assembling and locating in the process, it can be ensured that the coplanarity of the first welding portions 55 and the second welding portions 65 is good.

Figure 8:
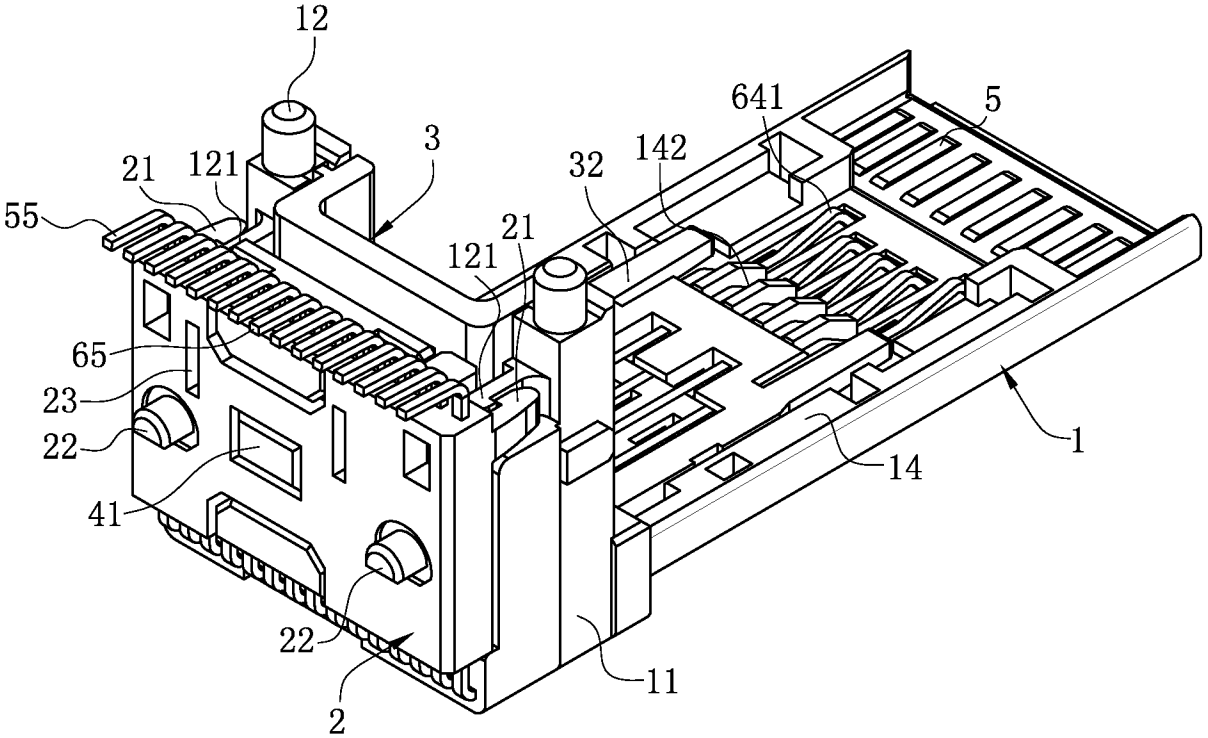
FIG. 8 is a schematic three-dimensional view of a first terminal and a second terminal which are synchronously bent of an electrical connector according to one embodiment of the present invention.

As shown in FIG. 1 and FIG. 8, at step d), the first terminals 5 and the second terminals 6 are synchronously bent downward at the locations of the pre-bent portions 56, so that the second fixing portions 52 and the first fixing portions 51 are bent from a flat and straight state to a mutually-perpendicular state, and the fourth fixing portions 62 and the third fixing portions 61 are bent from a flat and straight state to a mutually-perpendicular state. Moreover, the second body 2 and the fourth body 4 move as the second fixing portions 52 and the fourth fixing portions 62 are bent, so that the second body 2 and the first tongue plate 14 change from a parallel state to a perpendicular state, and the fourth body 4 and the second tongue plate 32 change from a parallel state to a perpendicular state. In the location changing process, the hooks 21 on the second body 2 may be buckled to the positioning posts 12 on the first body 1, so that the second body 2 and the first body 1 are fastened, and the third body 3 is clamped between the second body 2 and the first body 1. Because the first terminals 5 and the second terminals 6 are synchronously bent, and relative locations of the second body 2 and the fourth body 4 are unchanged before and after the first terminals 5 and the second terminals 6 are bent, relative locations of the first welding portions 55 and the second welding portions 65 are also unchanged, which can ensure that the first welding portions 55 and the second welding portions 65 are coplanar, and that each of the first welding portions 55 and each of the second welding portions 65 can keep good contact with the circuit board when welding is performed.

As shown in FIG. 2 and the FIG. 4, at step 5, the cylindrical portion 71 is externally sleeved on the first body 1 and the third body 3 from front to rear. In this case, the covering portion 72 and the cylindrical portion 71 are parallel in a length direction. Then, the covering portion 72 is bent to cover the rear end of the second body 2. In this case, the sheet-shaped portions 73 are located at two sides of the second body 2, and cover two side surfaces of the second body 2 and the third body 3, and the sheet-shaped portions 73 are buckled to a side surface of the positioning posts 12.

As shown in FIG. 4, at step 6, the shielding sheet 8 is fixed on the shell 7 in a laser spot welding manner, such that the shielding sheet 8 covers the front surface of the base portion 31. The shielding sheet 8 and the shell 7 can form integral shielding together.

After the foregoing steps are completed, the electrical connector 100 is welded on the circuit board. Because good planeness of the first welding portions 55 and the second welding portions 65 can be ensured, a welding effect is good, ensuring a reliable electrical connection between the electrical connector 100 and the circuit board.

To sum up, the method for manufacturing an electrical connector and the electrical connector 100 manufactured by using the same method according to certain embodiments of the present invention, have the following beneficial advantages.

(1) Each first terminal 5 is insert-molded in the first body 1 and the second body 2, each second terminal 6 is insert-molded in the third body 3 and the fourth body 4, and then the first body 1, the second body 2, the third body 3, and the fourth body 4 are separately assembled and positioned, which can ensure that the first welding portions 55 and the second welding portions 65 are located in a same row. Then, the first terminals 5 and the second terminals 6 are synchronously bent, and the relative locations of the first welding portions 55 and the second welding portions 65 are unchanged, which can ensure that the first welding portions 55 and the second welding portions 65 are located in a same row, thereby ensuring the welding planeness of the electrical connector 100, and further ensuring a reliable electrical connection.

(2) Viewed from the top, each third fixing portion 61 is located between two neighboring the first fixing portions 51, and the distance A between the first fixing portions 51 at the two sides of the third fixing portion 61 is greater than the distance B between two neighboring the first fixing portions 51 far from the third fixing portion 61, so as to make a distance between the first fixing portions 51 and the third fixing portions 61 as large as possible, achieving a better effect during high-frequency signal transmission.

(3) The first welding portions 55 are located at the two sides of the second welding portions 65. The numbers of the first welding portions 55 at the two sides of the second welding portions 65 are different. That is, the first welding portions 55 at the two sides of the second welding portions 65 are asymmetrically disposed, which improves the high-frequency performance.

The foregoing description of the exemplary embodiments of the invention has been presented only for the purposes of illustration and description and is not intended to be exhaustive or to limit the invention to the precise forms disclosed. Many modifications and variations are possible in light of the above teaching.

The embodiments are chosen and described in order to explain the principles of the invention and their practical application so as to activate others skilled in the art to utilize the invention and various embodiments and with various modifications as are suited to the particular use contemplated. Alternative embodiments will become apparent to those skilled in the art to which the present invention pertains without departing from its spirit and scope. Accordingly, the scope of the present invention is defined by the appended claims rather than the foregoing description and the exemplary embodiments described therein.

What is claimed is:

1. An electrical connector, comprising:

a plurality of first terminals, each having a first fixing portion, a second fixing portion bent and extended from a rear end of the first fixing portion, a first contact portion extended from a front end of the first fixing portion, and a first welding portion extended from a rear end of the second fixing portion;

a first body, fixed to the first fixing portions;

a second body, located at a rear of the first body and fixed to the second fixing portions, wherein the first body and the second body are separately formed;

a plurality of second terminals, each having a third fixing portion, a fourth fixing portion bent and extended from a rear end of the third fixing portion, a second contact portion extended from a front end of the third fixing portion, and a second welding portion extended from a rear end of the fourth fixing portion;

a third body, fixed to the third fixing portions, located below the first body, and fastened to the first body; and a fourth body, fixed to the fourth fixing portions but not the second fixing portions, and fastened to the second body, wherein the fourth body and the third body are separately formed.

2. The electrical of claim 1, wherein each of the first terminals further comprises a first bent portion disposed between the first fixing portion and the second fixing portion, and exposed from the first body and the second body; and wherein each of the second terminals further comprises a second bent portion disposed between the third fixing portion and the fourth fixing portion, and exposed from the third body and the fourth body.

3. The electrical connector of claim 2, wherein the first bent portions and the second bent portions are arranged in a same row.

4. The electrical connector of claim 1, wherein the first welding portions and the second welding portions are located in a same row.

5. The electrical connector of claim 1, wherein the first welding portions are located at two sides of the second welding portions, and numbers of the first welding portions located at two sides of the second welding portions are different.

6. The electrical connector of claim 1, wherein the second fixing portions are laterally bent relative to the first fixing portions, such that the second fixing portions and the fourth fixing portion are located in a same row, and the second fixing portions are located at two sides of the fourth fixing portion.

7. The electrical connector of claim 1, wherein viewed from top, the third fixing portions are located between two neighboring the first fixing portions.

8. The electrical connector of claim 7, wherein a distance between the first fixing portions located at two sides of the third fixing portions is greater than a distance between two neighboring the first fixing portions far from the third fixing portions.

9. The electrical connector of claim 1, wherein the first body comprises a first receiving slot and a second receiving slot disposed therein, the second receiving slot is located at a rear of the first receiving slot, the first contact portions are located in the first receiving slot, and the second contact portions extend out from the third body and are located in the second receiving slot.

10. The electrical connector of claim 1, wherein in a forward to backward direction, the fourth body is located between the second body and the first body.

11. The electrical connector of claim 1, wherein the fourth body comprises at least one protruding sheet protruded backward therefrom, and the protruding sheet extends between neighboring the second fixing portions, and coordinates with the second body for positioning.

12. The electrical connector of claim 1, wherein the first body has a main body portion and at least one positioning post extending downward from the main body portion, the second body is located at a rear of the positioning post, and at least one hook is extended forward from the second body and is buckled to the positioning post, such that the fourth body is held between the second body and the positioning post.

13. The electrical connector of claim 1, further comprising a shell covering the first body and the second body, and a shielding sheet spot-welded with the shell, such that the shell and the shielding sheet form integral shielding together.

* * * * *